US009217616B2

(12) United States Patent
Sullivan et al.

(10) Patent No.: US 9,217,616 B2
(45) **Date of Patent: *Dec. 22, 2015**

(54) EVIDENCE COLLECTING AND RECORDING APPARATUS FOR A GUN

(71) Applicants: Kevin Michael Sullivan, Kennebunk, ME (US); Karl F. Milde, Jr., Mahopac, NY (US); Jason C. Milde, Mahopac, NY (US)

(72) Inventors: Kevin Michael Sullivan, Kennebunk, ME (US); Karl F. Milde, Jr., Mahopac, NY (US); Jason C. Milde, Mahopac, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/640,171

(22) Filed: Mar. 6, 2015

(65) Prior Publication Data

US 2015/0176937 A1 Jun. 25, 2015

Related U.S. Application Data

(63) Continuation-in-part of application No. 13/855,891, filed on Apr. 3, 2013, now Pat. No. 9,140,509.

(51) Int. Cl.

| | |
|---|---|
| ***F41A 17/06*** | (2006.01) |
| ***F41A 35/00*** | (2006.01) |
| ***F41C 33/02*** | (2006.01) |
| ***F41G 1/00*** | (2006.01) |

(52) U.S. Cl.

CPC ..... *F41A 17/063* (2013.01); *F41A 17/066* (2013.01); *F41A 35/00* (2013.01); *F41C 33/029* (2013.01); *F41G 1/00* (2013.01)

(58) Field of Classification Search

CPC ..... F41A 17/063

See application file for complete search history.

(56) References Cited

U.S. PATENT DOCUMENTS

| | | | | |
|---|---|---|---|---|
| 6,823,621 | B2 * | 11/2004 | Gotfried | 42/70.06 |
| 2004/0246127 | A1 * | 12/2004 | Junqua | 340/539.13 |
| 2006/0042142 | A1 * | 3/2006 | Sinha | 42/1.01 |
| 2008/0204231 | A1 * | 8/2008 | Hietanen et al. | 340/568.1 |

* cited by examiner

*Primary Examiner* — Reginald Tillman, Jr.
(74) *Attorney, Agent, or Firm* — Karl F. Milde, Jr.

(57) ABSTRACT

A battery-powered electronic evidence-collecting device on the gun that transmits to a smartphone or other device carried by the peace officer for recording and forwarding the evidence to a central station. The evidence collecting and recording apparatus is activated by the removal of the gun from its holster.

9 Claims, 2 Drawing Sheets

EVIDENCE COLLECTING AND RECORDING APPARATUS FOR A GUN

CROSS-REFERENCE TO RELATED APPLICATION

This application is a continuation-in-part of utility patent application Ser. No. 13/855,891, filed Apr. 3, 2013, and entitled "EVIDENCE COLLECTING AND RECORDING APPARATUS FOR A GUN" (now pending) and claims priority therefrom.

BACKGROUND OF THE INVENTION

The present invention relates to an evidence collecting and recording apparatus for collecting and preserving evidence about the use of a gun.

When a police officer or a security guard discharges a gun while on duty there is always an investigation as to why the gun was used and whether the use of potentially lethal force was absolutely necessary under the particular circumstances that occurred. Questions of responsibility and liability are raised, especially when there was an injury or death resulting from this use of force.

Before a gun is discharged, the police officer or security guard must remove it from its holster in readiness to shoot. Under these circumstances the official is frequently in danger but is unable to call for assistance or "backup" because of the fast-moving pace of the events or because stealth is necessary to avoid revealing his or her presence at the scene.

SUMMARY OF THE INVENTION

It is a therefore principal object of the present invention to provide apparatus that automatically collects and records evidence of the use of a gun by a peace officer or some other person who is licensed or otherwise authorised to use the weapon.

It is a further object of the location to provide apparatus that automatically places a call for assistance when a gun is removed from its holster.

These objects, as well as other objects which will become apparent from the discussion that follows, are achieved, in accordance with the present invention, by providing a battery-powered, electronic evidence-collecting device on the gun that transmits to a smartphone or other device carried by the peace officer, for recording the evidence. Preferably, this evidence collecting and recording apparatus is activated by the removal of the gun from its holster and, also preferably, the apparatus causes the smartphone to automatically place a call for assistance when the gun is removed from its holster.

According to a preferred embodiment of the invention, the evidence collecting apparatus on the gun comprises:

(1) at least one sensor for sensing gun-related data;

(2) a first digital, logic device, coupled to the sensor or sensors, for receiving and forwarding the gun-related data; and (3) a wireless transmitter ("T") device, coupled to the first logic device, for transmitting the gun-related data received from the logic device.

According to the present invention the evidence recording apparatus includes a portable device, such as a smartphone, that comprises:

(1) a wireless receiver ("R") device, for receiving the gun-related data from the T device;

(2) a wireless telephone device connectable to a telephone network for transmitting data to a central station via the network; and (3) a second digital logic device, coupled, to the R device for receiving and forwarding the gun-related data to the central station.

Advantageously, the evidence collecting and recording apparatus further comprises a gun holster for holding the gun and one of the first sensors includes a device for determining when said gun is removed from said holster.

Advantageously too, the portable device includes a data memory, coupled to the second logic device, for recording the evidence received by transmission from the data collecting apparatus prior to uploading it to the central station.

According to another preferred embodiment of the invention, the second logic device is programmed to automatically initiate a call for assistance upon receipt of gun-related data from the evidence-collecting device.

According to still another preferred embodiment of the present invention, the gun is provided with one or more of the following evidence collecting sensors:

(i) a holster sensor for sensing that the gun is removed from a holster;

(ii) a video camera arranged to view forward in the direction of aim of the gun and/or in the direction of the holder of the gun;

(iii) a microphone arranged to receive sounds in the vicinity of the gun;

(iv) a direction finder for determining the azimuthal direction of aim of the gun;

(v) a trigger-pull sensor, or other sensor device such as the microphone or an accelerometer, for sensing that the gun has been fired; and (vi) a level sensor for determining the angle of aim of the gun with respect to the vertical.

Finally, according to still another preferred embodiment of the present invention, the portable device is provided with one or more of the following evidence collecting devices:

(i) a clock for determining the time that the gun is removed from the holster and/or the time that the gun is fired; and (ii) a GPS for determining the location of the gun when it is removed from the holster and/or when it is fired.

DETAILED DESCRIPTION OF THE PREFERRED EMBODIMENTS

Figure 1:
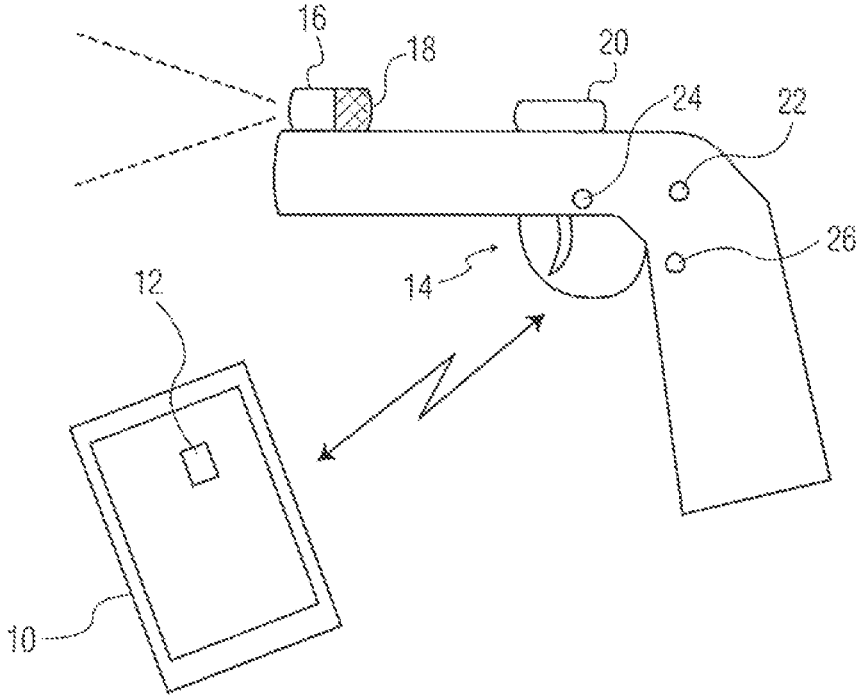
FIG. 1 is a representational diagram showing a smartphone and a gun that is equipped with an electronic evidence-collecting device according to the present invention.

The preferred embodiments of the present invention will now be described with reference to FIGS. 1-3 of the drawings. Identical elements in the various figures are identified with the same reference numerals.

FIG. 1 shows a battery-operated portable device such as a smartphone 10 having an application or "app" 12 which may be selected by the user or run continuously in the background, for example when the user is "on duty" as a peace officer. The portable device communicates wirelessly, for example by Bluetooth or Wifi protocol, with an evidence-collecting device on a handgun 14. The evidence-collecting device includes a number of sensors 16, 18, 20, 22, 24 and 26 connected to a logic device with a (e.g. Bluetooth or Wifi) transmitter. Wifi may be preferred over Bluetooth because of the greater bandwidth available for transmission of information.

The sensors preferably include:

(1) a video camera 16 arranged to view in the direction of aim of the gun 14 and/or in the direction of the holder of the gun;

(2) a microphone 18 arranged to receive audio from the user of the gun;

(3) a direction finder 20 arranged to detect the azimuthal direction in which the gun is aimed;

(4) a light sensor, magnetic sensor or any other type of sensor 22 for detecting when the gun has been removed from a holster;

(5) a trigger-pull sensor or any other type of sensor device 24, such as the aforementioned microphone or an accelerometer, for sensing that the gun has been fired; and (6) a level sensor 26 for determining the angle of aim of the gun with respect to the vertical.

Figure 2:
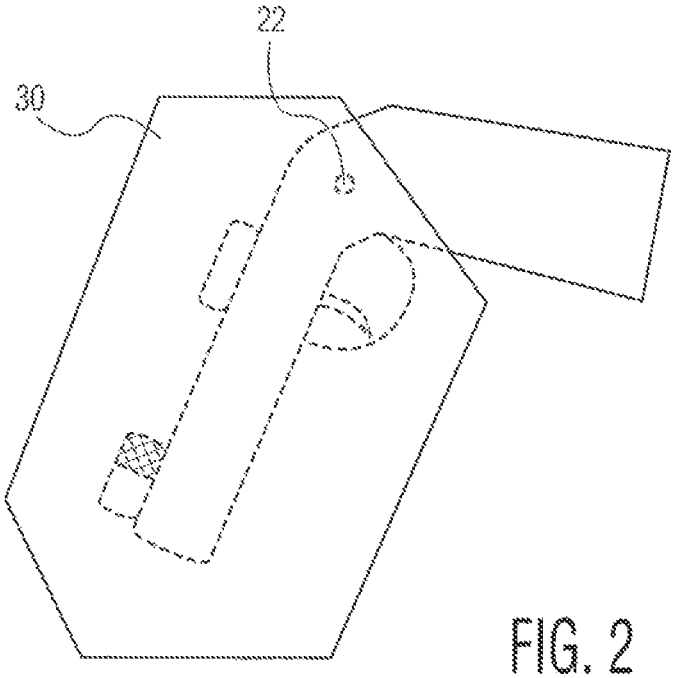
FIG. 2 is a close-up view of the gun of FIG. 1 arranged in a holster.

As shown in FIG. 2, the light sensor 22 is covered when the gun is holstered. When removed from its holster 30, the sensor 22 receives light and detects this removal. Output from the light sensor 22 initiates the collection of gun-related data from the other sensors 16, 18 and 20, 24 and 26.

Figure 3:
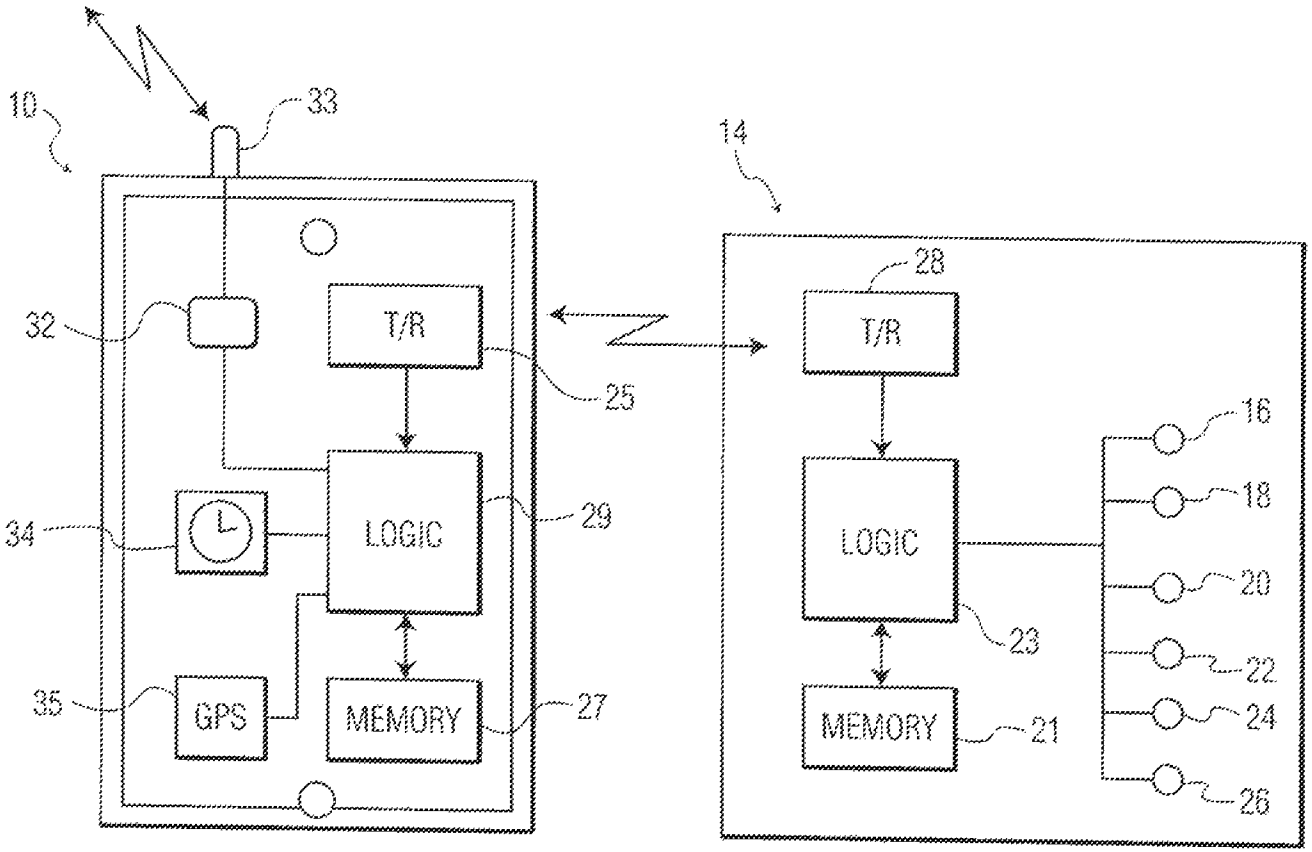
FIG. 3 is a block diagram showing a preferred embodiment of the evidence collecting and recording apparatus according to the present invention.

FIG. 3 is a block diagram showing the evidence-collecting device on the gun 14 and the portable device 10 to which it transmits. The evidence-collecting device includes a number of sensors 16, 18, 20, 22, 24 and 26 all connected to a logic device 23 which is activated upon removal of the gun from its holster and forwards the sensed, gun-related data via a first transmitting/receiving ("T/R") device 28 (for example, Bluetooth or Wifi) to the portable device 10. As required, the gun related data may be stored in a data memory 21.

The portable device 10 receives the gun-related data via a second T/R device 25 (for example, Bluetooth or Wifi) and a second logic device 29 and temporarily records this data in a memory 27. Thereafter, the portable device 10 uploads the gun-related data via its cell phone transmitter 32 and antenna 33 to a central station (not shown). The video information is preferably transmitted a lower frame rate than the standard frame rate for video, and/or with a lower resolution than the standard resolution, in order to rapidly upload the video images to the central station (e.g., a police station) for immediate viewing and responsive action.

Immediately upon receipt of a signal that the user's gun has been removed from its holster, the logic device 29 can automatically cause the portable device 10 to make a cell phone call to the user's partner and/or to the central station to request assistance, and backup. The portable device (e.g., smartphone) can also automatically commence taking pictures or shooting a video, and can start recording sound from its own camera and microphone, respectively. If the phone is located on the shoulder of the peace officer, for example, or if it is held in the officer's hand, it can collect important evidence at this critical time.

When so activated and when recording the gun-related data transmitted from the gun in its memory 27, the portable device 10 can also record the exact time and location of each significant event, such as the removal of the gun from its holster or the firing of the gun, using its internal clock 34 and GPS locator 35.

There has thus been shown and described a novel evidence collecting and recording apparatus for a gun which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. Evidence collecting and recording apparatus for collecting and preserving evidence of an event relating to the use of a gun, said evidence recording apparatus comprising, in combination:

(a) a gun having a first source of electrical power and an electronic evidence collecting device, coupled to said first source of power, that comprises:

(1) at least one sensor for sensing gun-related data and for producing signals representing said gun-related data;

(2) a video camera, disposed on said gun, for producing signals representing video ages in a direction of aim of the gun;

(3) a wireless transmitter ("T") device transmitting signals representing said gun-related data and said video images; and (4) a first digital logic device, coupled to said at least one sensor, to said video camera and to said T device, for receiving and sending signals representing said gun-related data and said video images to said T device; and (b) a portable device for use by a person authorized to carry said gun and having a having a second source of electrical power and an evidence recording device, coupled to the second source of power, that comprises:

(1) a wireless receiver ("R") device for receiving said signals representing said gun-related data and said video images transmitted from said T device;

(2) a wireless telephone device connectable to a telephone network for transmitting data to a remote central station via said network; and (3) a second digital logic device, coupled to said R device and to said telephone device, for receiving and sending signals representing said gun-related data and video images to said central station via said telephone network;

wherein said portable device comprises a smartphone with a app for controlling said second digital logic device.

2. The apparatus defined in claim 1, further comprising a gun holster for holding said gun; wherein said at least one sensor includes a sensor device for determining when said gun is removed from said holster, and wherein said first logic device is operative to activate the video camera and to cause said T device to transmit said signals representing said gun-related data and said video images to said R device when said sensor device determines that the gun has been removed from the holster.

3. The apparatus defined in claim 1, wherein said portable device includes a data memory, coupled to the second logic device, for storing the gun-related data received from the data collecting device.

4. The apparatus defined in claim 1, wherein said electronic evidence collecting device includes a data memory, coupled to the first logic device, for storing the gun-related data.

5. The apparatus defined in claim 1, wherein said at least one sensor is selected from the group consisting of:

(i) a holster sensor for sensing that the gun is removed from a holster;

(ii) a microphone arranged to receive sounds in the vicinity of the gun;

(iii) a direction finder for determining the azimuthal direction of aim of the gun;

(iv) a device for determining that the gun is fired; and (v) a level sensor for determining the angle of aim of the gun with respect to the vertical.

6. The apparatus defined in claim 1, wherein said portable device further includes a device selected from the group consisting of:

(i) a clock for determining the time that the gun is used; and (ii) a GPS for determining the location of the gun when it is used;

(iii) a video camera for viewing the scene when the gun is used; and (iv) a microphone for transducing sounds when the gun is used;

wherein at least one of said time, location, scene and said sounds are stored in the data memory along with the gun-related data.

7. The apparatus defined in claim 1, wherein said second logic device is programmed to automatically initiate a call for assistance upon receipt of gun-related data from said evidence collecting device.

8. The apparatus defined in claim 5, wherein said second logic device is programmed to transmit video information to the central station at a lower frame rate than the frame rate at which the video information was captured by the video camera.

9. The apparatus defined in claim 1, wherein said second logic device is programmed to transmit video information to the central station at a lower image resolution than the resolution at which the video information was captured by the video camera.

* * * * *